United States Patent [19]

Rose et al.

[11] 4,199,024

[45] Apr. 22, 1980

[54] MULTISTAGE GAS GENERATOR

[75] Inventors: Leslie C. Rose, Rocky Mount; Joseph T. Hamrick, Roanoke, both of Va.

[73] Assignee: World Energy Systems, Fort Worth, Tex.

[21] Appl. No.: 4,457

[22] Filed: Jan. 18, 1979

Related U.S. Application Data

[63] Continuation of Ser. No. 886,105, Mar. 13, 1978, abandoned, which is a continuation-in-part of Ser. No. 756,129, Jan. 3, 1977, Pat. No. 4,078,613, which is a continuation of Ser. No. 602,680, Aug. 7, 1975, abandoned, which is a continuation-in-part of Ser. No. 534,778, Dec. 20, 1974, Pat. No. 3,982,591.

[51] Int. Cl.[2] ..... E21B 43/24

[52] U.S. Cl. ..... 166/59; 166/53; 431/179; 431/190; 431/285

[58] Field of Search ..... 166/59, 53, 57, 58, 166/65R, 302, 303, 251, 256, 250; 60/39.55; 431/158, 285, 190, 179; 126/360 A; 432/179, 194

[56] References Cited

U.S. PATENT DOCUMENTS

| | | | |
|---|---|---|---|
| 2,168,313 | 8/1939 | Bichovsky | 60/39.55 |
| 2,506,853 | 5/1950 | Berg et al. | 166/59 |
| 2,584,606 | 2/1952 | Merriam et al. | 166/59 X |
| 2,734,578 | 2/1956 | Walter | 166/302 UX |
| 2,890,754 | 6/1959 | Hoffström et al. | 166/59 |
| 3,360,044 | 12/1967 | Lange | 166/57 X |
| 3,372,754 | 3/1968 | McDonald | 166/59 |
| 3,456,721 | 7/1969 | Smith | 166/59 |
| 3,633,886 | 1/1972 | Froberg | 432/179 X |
| 3,700,035 | 10/1972 | Lange | 166/57 X |
| 3,880,235 | 4/1975 | Berry et al. | 166/302 |

*Primary Examiner*—Stephen J. Novosad
*Attorney, Agent, or Firm*—Allan R. Fowler

[57] ABSTRACT

A multistage gas generator for use in a borehole for recovering hydrocarbons from the subsurface formations. The gas generator has an upper end and a lower restricted outlet. A pilot stage is located at the upper end and a plurality of spaced apart intermediate stages are located between the pilot stage and the lower restricted outlet. Hydrogen and oxygen are fed to the pilot stage for ignition. Oxygen is fed to a first intermediate stage and hydrogen and oxygen are fed to each of the other intermediate stages for injection into the gas generator. Excess hydrogen from the pilot stage is burned in the zone of the first intermediate stage and hydrogen and oxygen of each succeeding stage is ignited by the preceeding stage. Water for cooling purposes also is fed to each intermediate stage. Downhole valves selectively controllable from the surface are provided for the pilot stage and each of the intermediate stages. These valves allow the intermediate stages to be selectively operated to increase or decrease the BTU output or to vary other characteristics of the output.

14 Claims, 5 Drawing Figures

MULTISTAGE GAS GENERATOR

This application is a continuation of U.S. Patent Application Ser. No. 886,105, filed Mar. 13, 1978, now abandoned, which is a continuation-in-part of U.S. Patent Application Ser. No. 756,129, filed Jan. 3, 1977, now U.S. Pat. No. 4,078,613, which is a continuation of U.S. Patent Application Ser. No. 602,680, filed Aug. 7, 1975, now abandoned, which is a continuation-in-part of U.S. Patent Application Ser. No. 534,778, filed Dec. 20, 1974, now U.S. Pat. No. 3,982,591.

SUMMARY OF THE INVENTION

It is an object of the present invention to provide a multistage gas generator for use in a borehole for recovering hydrocarbons or other materials from the subsurface formations.

It is a further object of the present invention to provide a multistage gas generator wherein each stage is selectively controllable to increase or decrease the BTU output or to vary other characteristics of the output. By the use of a plurality of stages, each selectively controllable, the system can be controlled digitally by a computer.

DETAILED DESCRIPTION OF THE INVENTION

Figures 1, 3, 4:
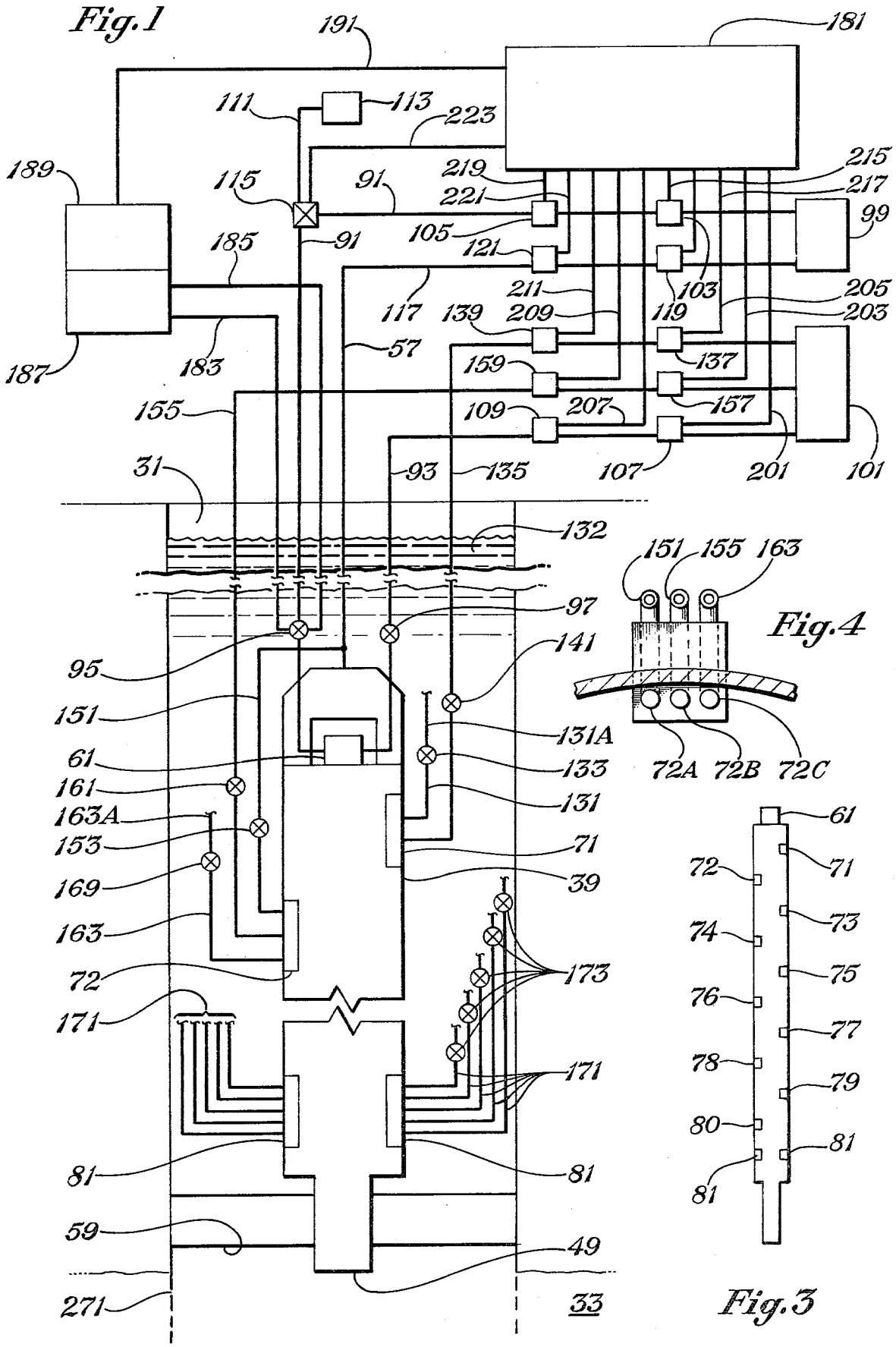
FIG. 1 illustrates the gas generator located in a borehole for use for recovering hydrocarbons from the subsurface formations.
FIG. 3 illustrates all of the stages of one embodiment of the gas generator.
FIG. 4 is a view of FIG. 2A taken along the lines 4—4 thereof.

Referring to FIG. 1, there is illustrated a cased injection borehole 31 which penetrates a subsurface oil bearing formation 33. Supported in the borehole is a gas generator 39 for producing hot gases to thermally or permanently reduce the viscosity of the oil to be recovered by the most economical process available. In the recovery process, the oil in the formation 33 is driven to other spaced boreholes (not shown) which penetrate formation 33, for recovery purposes, in a manner well known to those skilled in the art.

Figure 2A:
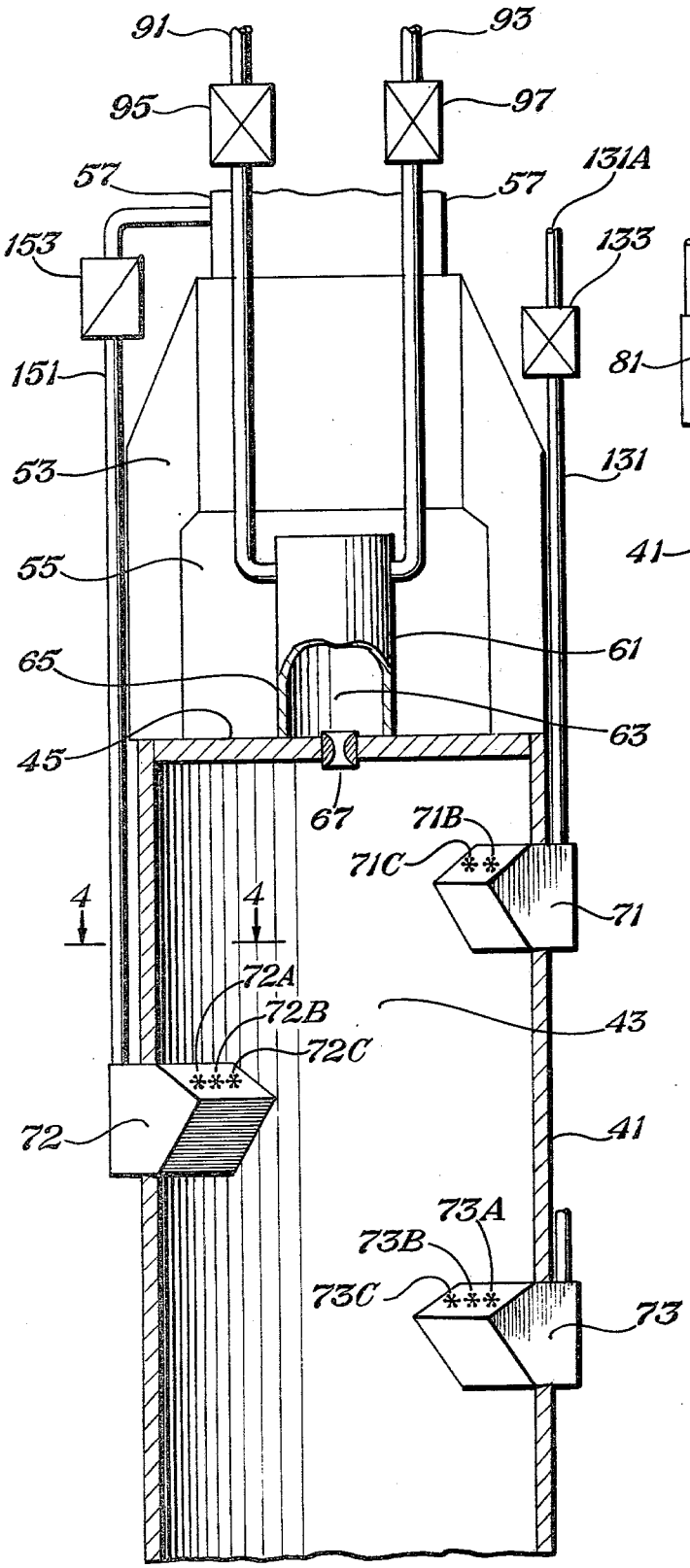
FIGS. 2A and 2B illustrate the gas generator in cross-section. The top portion of FIG. 2B is a continuation of the bottom portion of FIG. 2A.
Figure 2B:
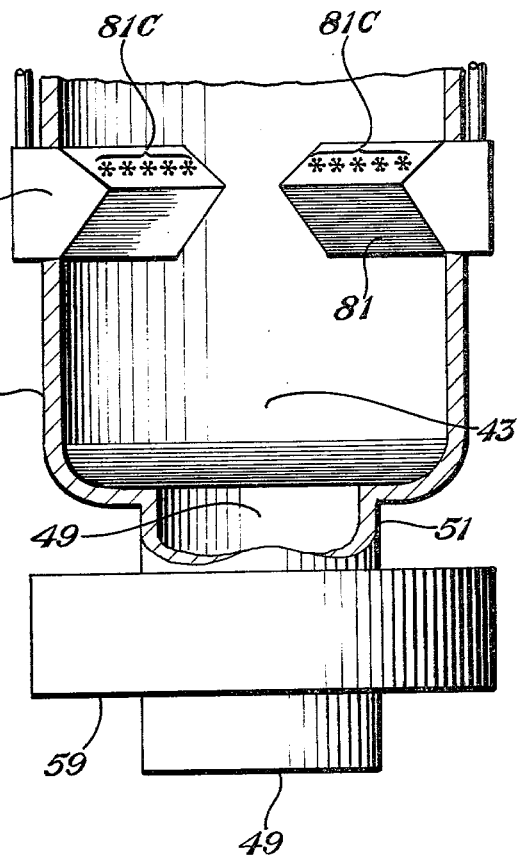

Referring also to FIGS. 2–4, the gas generator 39 comprises a cylindrical shell 41 defining a main chamber 43 and having a top wall 45 and a lower outlet 49 which may be restricted and formed by cylindrical structure 51 as shown in FIG. 2B. Attached to the top wall 45 is support structure 53 defining an open space 55. Attached to the support structure 53 is a main support conduit 57 which extends to the surface and supports the gas generator in the borehole. Conduit 57 is supported at the surface by structure not shown. A packer 59 for engaging the walls of the borehole is supported around cylindrical structure 51.

Attached to the top wall 45 is a pilot stage 61 which comprises a pilot chamber 63 formed by cylindrical wall structure 65. A restricted outlet 67 extends through wall 45 from the pilot chamber 63 to the main chamber 43. Located along the length of the shell 41 between the pilot stage 61 and the lower restricted outlet 49 are a plurality of intermediate stages 71–80. Stages 74–80 are not shown in FIG. 2A but are illustrated in FIG. 3. Stages 74–80 are the same as stages 72 and 73. Located between stage 80 and the restricted outlet 49 is a final stage 81.

Extending from the surface to the pilot stage 61 are a hydrogen supply conduit 91 and an oxygen supply conduit 93. Coupled to conduits 91 and 93, near the gas generator are remotely controllable valves 95 and 97. At the surface, hydrogen supply conduit 91 is coupled to a source of hydrogen 99 and oxygen supply conduit 93 is coupled to a source of oxygen 101. A flow meter 103 and flow regulator 105 are coupled to the hydrogen supply conduit 91 and a flow meter 107 and flow regulator 109 are coupled to the oxygen supply conduit 93. Also coupled to the hydrogen supply conduit 91 by way of a conduit 111 is a source 113 of hypergolic fuel such as triethyl borane. A three way valve 115 controls the flow of either hydrogen or the hypergolic fuel through conduit 91 downhole to the gas generator.

At the surface, the main support conduit 57 is coupled to the hydrogen source 99 by way of a conduit 117 whereby hydrogen is supplied downhole through conduit 57. A flow meter 119 and a flow regulator 121 are coupled to conduit 117.

In the gas generator, the first intermediate stage 71 includes an oxygen nozzle 71B and a water nozzle 71C for injecting oxygen and water into the main chamber 43. Each of the other intermediate stages 72–80 includes a hydrogen nozzle, an oxygen nozzle and a water nozzle for injecting hydrogen, oxygen, and water into the main chamber 43. The hydrogen, oxygen and water nozzles of stage 72 are identified at 72A, 72B, and 72C, respectively. The hydrogen, oxygen and water nozzles of stage 73 are identified at 73A, 73B, and 73C, respectively. The final stage 81 has only water nozzles for injecting water into the lower end of the main chamber. These water nozzles total 10 in number and are identified at 81C.

Downhole, a water conduit 131 is coupled to the water nozzle 71C of stage 71 and has its end 131A open to the water 132 in the borehole for supplying borehole water to the nozzle 71C. A remotely controllable valve 133 is coupled to conduit 131 for allowing or terminating the flow of borehole water to the nozzle 71C.

A conduit 135 extends from the oxygen source 101 at the surface downhole to oxygen nozzle 71B of stage 71 for supplying oxygen to this nozzle. At the surface, a flow meter 137 and a flow regulator 139 are coupled to conduit 135. In the borehole near the gas generator, a remotely controllable valve 141 is coupled to conduit 135 for allowing or terminating the flow of oxygen to nozzle 71B.

Downhole, a conduit 151 extends from the main support conduit 57 to the hydrogen nozzle 72A of stage 72 to supply hydrogen to this nozzle. In the borehole near the gas generator, a remotely controllable valve 153 is coupled to conduit 151 for allowing or terminating the flow of hydrogen to nozzle 72A.

A conduit 155 extends from the oxygen source 101 at the surface downhole to oxygen nozzle 72B of stage 72 for supplying oxygen to this nozzle. At the surface a flow meter 157 and a flow regulator 159 are coupled to conduit 155. In the borehole near the gas generator, a remotely controllable valve 161 is coupled to conduit 155 for allowing or terminating the flow of oxygen to nozzle 72B.

Water 132 from the borehole is supplied to the nozzle 72C of stage 72 by way of a conduit 163 which is coupled to the nozzle and has its end 163A open to the water in the borehole. A remotely controllable valve 169 is coupled to conduit 163 for allowing or terminating the flow of water to nozzle 72C.

Each of the other stages 73–80 has hardware similar to that of stage 72 for supplying hydrogen, oxygen, and water to its hydrogen, oxygen and water nozzles. In this respect, each of the other stages 73–80 has a conduit similar to conduit 151 coupled from main support conduit 57 to its hydrogen nozzle with a remotely controllable valve similar to valve 153 coupled to this conduit. Each of the other stages 73–80 has a conduit similar to conduit 155 extending from the oxygen source 101 downhole to its oxygen nozzle with a flow meter and flow regulator similar to flow meter 157 and flow regulator 159 located at the surface and a remotely controllable valve similar to valve 161 located downhole near the gas generator. In addition, each of the other stages 73–80 has a conduit similar to conduit 163 coupled to its water nozzle with a remotely controllable valve similar to valve 169 coupled to the conduit.

The final stage 81 has 10 conduits 171 coupled to its 10 water nozzles respectively for supplying water from the borehole to the water nozzles. Each conduit 171 has a remotely controllable valve 173 coupled thereto (only 5 are shown) for allowing or terminating the flow of water to its water nozzle.

Each of the downhole remotely controllable valves 95, 97, 133, 141, 153, 161, 169, 173, and those not shown but employed for stages 73–80 are separately controllable from the surface by an uphole digital computer illustrated at 181. Valve 95 will be described as typical. It comprises a ball valve operable by pneumatic or hydraulic pressure from the surface. It has two conduits 183 and 185 extending to the surface to a source 187 of pneumatic or hydraulic fluid and which is controlled by a control system 189 for opening or closing the valve. Control system 189 in turn is controlled by computer 181 through a control line 191. Each of the other downhole remotely controllable valves is a ball valve having conduits similar to conduits 183 and 185 extending to the surface to a pneumatic or hydraulic supply and control system similar to 187 and 189, each of which is separately controllable by the computer 181 for selectively opening or closing each of these valves.

Each of the uphole flow regulators of the oxygen conduits of stages 61, and 71–80 is separately controllable by the computer to selectively control the amount of oxygen flowing to the stages 61 and 71–80. For example, the computer 181 senses the flow through oxygen conduits 93, 155 and 135 by way of lines 201, 203 and 205 coupled to flow meters 107, 157 and 137 and operates flow regulators 109, 159 and 139 by way of lines 207, 209 and 211 to selectively control the amount of oxygen flowing to stages 61, 72, and 71 depending upon the desired results. It is to be understood that the computer will be coupled to the flow meters and flow regulators of the oxygen conduits of stages 73–80 to selectively control the amount of oxygen flowing to these stages.

The amount of hydrogen flowing through conduits 57 and 91 also is selectively controlled by the computer. In this respect, the computer senses the flow through lines 91 and 57, 117 by way of lines 215 and 217 coupled to flow meters 103 and 119 and operates flow regulators 105 and 121 by way of lines 219 and 221 to selectively control the amount of hydrogen flowing to stage 61 and through conduits 117, 57 to stages 72–80.

The computer 181 also controls the three way valve 115 by way of line 223.

Although not shown, each of the uphole controls 189 for its respective downhole valve will have a manual control to selectively control the downhole valves manually in case of computer breakdown. In addition, each of the uphole flow regulators will have a manual control to selectively control manually the amount of hydrogen and oxygen flowing downhole to the different stages in case of computer breakdown.

After the gas generator and equipment has been inserted into the borehole to the desired depth and the borehole has been filled with water to the desired level, the system is ready for operation. Start up operation is as follows assuming that all 10 stages 71–80 are desired to be operated. Initially, all of the downhole valves will be closed. Valve 115 also will be closed to block the flow of fluid downhole through conduit 91. All of the uphole flow regulators will be actuated and set to the desired value to allow hydrogen and oxygen to flow downhole through the various conduits to the closed downhole valves. As mentioned above, valve 115 at this time will block the flow of fluid downhole through conduit 91. Valve 115 will be actuated to allow a slug of the hypergolic or start-up fuel to flow downhole through conduit 91 to closed valve 95. Next valve 115 will be actuated to allow hydrogen to flow downhole through conduit 91 behind the slug of hypergolic fuel in conduit 91. Valves 95 and 97 then will be opened to allow the slug of hypergolic fuel and oxygen to flow into the pilot chamber 63 where the hypergolic fuel will spontaneously ignite when it contacts the oxygen. The hydrogen which follows the hypergolic slug in conduit 91 then will be ignited and burned in the pilot chamber 63. Combustion will be supported by the oxygen flowing through conduit 93 into chamber 63. Reference is made to U.S. Pat. No. 4,053,015 for a more detailed description of this type of ignition process. The resulting hot gases flow through restricted outlet 67 into the main chamber 43. Preferably, the combustible mixture in pilot stage 61 is hydrogen rich to maintain the temperature below 2,000° F.

Next valves 141 and 133 will be opened allowing oxygen and water to be injected into the main chamber 43 through nozzles 71B and 71C. Valve 141 will be opened first followed by the opening of valve 133. The oxygen allows the excess hydrogen flowing through restricted outlet 67 to be burned and the water maintains the temperature in the zone of stage 71 between 1,600° F. to 2,000° F. At this time, one of the water valves 173 will be opened to inject borehole water into the lower end of the chamber 43 to further cool the exhaust gases.

Valves 161, 153 and 169 of stage 72 next will be opened to inject oxygen, hydrogen, and water into the main chamber through nozzles 72B, 72A and 72C. The sequence of opening will be valve 161 first, valve 153 next and valve 169 last. The combustible mixture of hydrogen and oxygen from nozzles 72A and 72B is ignited by the hot gases resulting from the burning of hydrogen and oxygen from stage 71. The water from nozzle 72C cools the generator and maintains the temperature in the zone of stage 72 between 1,600° F. and 2,000° F. At this time another water valve 173 will be opened. The hydrogen, oxygen and water valves of each of stages 73–80 will be sequentially opened whereby the hydrogen and oxygen from each of these stages will be ignited by the hot gases from the preceeding stage. The temperature in the zones of each of these stages will be maintained between 1,600°–2,000° F. by the water injected from the stages. As each stage is turned on, one of the water valves 173 will be opened to further cool the exhaust gases and to maintain the exhaust temperature at about 600° F. The exhaust gases and steam flow through the restricted outlet 49 into the borehole and through casing perforations 271 into the formations. The uphole computer 181 will sense the hydrogen and oxygen pressure by way of the uphole flow meters and control the downhole hydrogen and oxygen flow by way of the uphole flow regulators in accordance with desired values.

Shut down is carried out by sequentially closing the downhole valves hydrogen and oxygen valves of stages 61 and 71–80 in a reverse manner. The water valves will be turned off as a final step.

If less than the maximum obtainable BTU output is desired, a selected number of the intermediate stages 72–80 will be shut off preferably starting with the lowest stage 80. The remaining intermediate stages including stage 71 and pilot stage 61 then will be operated to obtain the desired BTU output. If it is desired to obtain a hydrogen rich output for insitu hydrogenation, a selected number of downhole oxygen valves of the intermediate stages 72–80 will be closed preferably starting with the downhole oxygen valve of the lowest operating stage. The hydrogen valves of all of the operating stages will be open. Similarly, if it is desired to obtain an oxygen rich output, a selected number of downhole hydrogen valves of the intermediate stages 72–80 will be closed preferably starting with the downhole hydrogen valve of the lowest operating stage. The oxygen valves of all of the operating stages will be open. Thus, all of the system operating modes (steam, excess oxygen, excess hydrogen) may be computer controlled by above ground ingredient flow measurements, thus eliminating the necessity of downhole pressure temperature instrumentation.

In one embodiment, the gas generator 39 including shell 41, top 45, output structure 51 and pilot stage 61 and other equipment may be constructed of 310 stainless steel. The main support conduit 57 may have an inside diameter of $2\frac{7}{8}$ inches with the oxygen conduits and hydrogen conduit 91 having an inside diameter of $\frac{1}{2}$ of an inch. Suitable filters will be employed for the downhole water conduits. The hydrogen and oxygen conduits 91 and 93 supply hydrogen and oxygen from the surface at twice the pressure for the other stages. The above sizes were based on the ten stage design operating at 20 to 60 million BTU per hour at a depth of 3,000 feet. For a total output of 20 million BTU per hour, the system may be designed and operated in the following manner. 32.78 pounds per hour of hydrogen and 38.48 pounds per hour of oxygen are fed to pilot stage 61. Its temperature is maintained at about 2000° F. 221.72 pounds per hour of oxygen and 814.2 pounds per hour of water are fed to stage 71. The combined output of stages 61 and 71 is 2 million BTU per hour at 1,600° F. 32.78 pounds per hour of hydrogen, 260.2 pounds per hour of oxygen and 814.2 pounds per hour of water are fed to stage 72. Its output is 2 million BTU per hour at 1,600° F. Each of stages 73–80 are operated in the same manner as stage 72. 571.51 pounds per hour of water are fed to each of nozzles 81C of stage 81 to lower the exhaust temperature to 600° F. For this data, the combined output of the 10 stages is steam at 16,787 pounds per hour with a total BTU output of 20 million per hour.

The ten stages 71–80 shown in FIGS. 2A, 2B and 4 were chosen for ease of computer programming and system design calculations. It is to be understood that the gas generator may have a different number of intermediate stages.

For a 10 stage system, the system would operate in the 100 percent steaming mode from 20 to 60 million BTU per hour. For any given total flow, the system is capable of a 10 to 1 flow change without changing supply pressure by shutting off stages. If the system is operating at 20 million BTU per hour flow then the flow range would be 2 to 20 million BTU per hour in increments of 2 million BTU per hour. If the total flow is 60 million BTU per hour the flow change possible per stage would be 6 million BTU per hour or the system would have a 3 to 1 flow change by changing supply pressure. The system would offer the maximum flow with minimum pressure drop therefore increasing the efficiency over fixed orifice systems by reducing the energy required to pressurize the hydrogen and oxygen. The system is ideal for computer control since it will be digital in nature rather than analogue, which would be the case if the system flow was controlled by pressure and fixed orifices. The system is easy to shift from pure steam to excess hydrogen or oxygen since all that would be required is the shutting off of the required number of valves in the selected stages. The hazards associated with high-flow start-up has been eliminated by the pilot generator that would operate at 2,000° F. using only hydrogen and oxygen. As indicated above, ignition is achieved by placing a charge of triethyl borane in the hydrogen line to pilot generator and allowing it to flow to the bottom shut off valve. The generator then is ignited by the hypergolic reaction of triethyl borane with oxygen. The other stages are introduced into the main generator in a manner programmed to achieve stable combustion and flow without hot spots and chamber burn thru. One of the major advantages of the ten stage system is the large increase in reliability due to the natural redundency created by the stages being in parallel.

Although hydrogen and oxygen were described as being used as the fuel and fluid oxidizer for the system, it is to be understood that other fuels and oxidizers may also be used. In addition, hypergolic fuels other than triethyl borane may be used to achieve ignitions. Other types of hypergolic fuels are disclosed in U.S. Pat. No. 4,053,015. The packer 59 may be a commercially available packer. One suitable commercial packer is known as the EMJAY Packer. It is mechanically actuated by rotating the gas generator by way of the main support conduit 57 which is fixedly attached to the gas generator and extends to the surface.

What is claimed is:

1. A system for recovering hydrocarbons or other materials from underground formations penetrated by a borehole comprising:

a gas generator including, means defining a main chamber having an upper end and a lower outlet for the passage of heated gases, a pilot stage disposed at the upper end of said gas generator and including a pilot chamber having a restricted outlet communicating with said main chamber, a plurality of spaced apart intermediate stages located between said pilot stage and said lower outlet, a predetermined number of said plurality of intermediate stages including fuel and oxidizing fluid nozzles communicating with said main chamber, means adapting said gas generator for insertion into a borehole to a level adjacent underground formations penetrated thereby;

means for supplying fuel and an oxidizing fluid to said pilot chamber for ignition therein; and, means for supplying fuel and an oxidizing fluid to each of said predetermined number of said intermediate stages for injection into said main chamber through the fuel and oxidizing fluid nozzles, respectively, for ignition at a plurality of spaced apart zones.

2. The system of claim 1 further including valve means for selectively controlling the flow of fuel and oxidizing fluid to each of said fuel and oxidizing nozzles of each of said predetermined number of said intermediate stages.

3. The system of claim 2 further including valve means for selectively controlling the flow of fuel and oxidizing fluid to said pilot chamber.

4. The system of claim 1 wherein each of said intermediate stages are disposed in an operative relationship with one another and said pilot stage, with hot gases from each stage igniting fuel injected into said chamber from a succeeding stage upon start up of the gas generator.

5. A system for recovering hydrocarbons or other materials from underground formations penetrated by a borehole comprising:

a gas generator including, means defining a main chamber having an upper end and a lower outlet for the passage of heated gases, a pilot stage disposed at the upper end of said gas generator and including a pilot chamber having a restricted outlet communicating with said main chamber, a plurality of spaced apart intermediate stages disposed between said pilot stage and said lower outlet, a predetermined number of said plurality of intermediate stages comprising a fuel nozzle, an oxidizing fluid nozzle and a water nozzle, communicating with said main chamber, means adapting said gas generator for insertion into a borehole to a level adjacent underground formations penetrating thereby;

means for supplying fuel and an oxidizing fluid to said pilot chamber for ignition therein;

means for supplying fuel and an oxidizing fluid to each of said predetermined number of said intermediate stages for injection into said main chamber through the fuel and oxidizing fluid nozzles, respectively, for ignition at a plurality of spaced apart zones; and means for supplying water to each of said water nozzles of said predetermined number of said intermediate stages for injection into said main chamber.

6. The system of claim 5 further including valve means for selectively controlling the flow of fuel, oxidizing fluid and water to each of said fuel, oxidizing fluid and water nozzles.

7. The system of claim 6 wherein the gas generator includes a final stage disposed between a last of said intermediate stages and said lower outlet, said final stage including water nozzle means communicating with said main chamber, and the system further includes means for supplying water to said water nozzle means for injection into said main chamber.

8. The system of claim 7 further including valve means for selectively controlling the flow of water to said water nozzle means.

9. The system of claim 6 wherein the gas generator includes an upper intermediate stage disposed between said pilot stage and a first of said predetermined number of said intermediate stages, said upper intermediate stage including an oxidizing fluid nozzle and a water nozzle communicating with said main chamber; and, the system further includes means for supplying an oxidizing fluid and water nozzles respectively of said upper intermediate stage for injection into said main chamber.

10. The system of claim 9 further including valve means for selectively controlling the flow of oxidizing fluid and water to said oxidizing fluid and water nozzles respectively of said upper intermediate stage.

11. The system of claim 8 wherein the gas generator includes an upper intermediate stage disposed between said pilot stage and a first of said predetermined number of said intermediate stages, said upper intermediate stage including an oxidizing fluid nozzle and a water nozzle communicating with said main chamber; and, the system further includes means for supplying an oxidizing fluid and water to said oxidizing fluid and water nozzle respectively of said upper intermediate stage for injection into said main chamber.

12. The system of claim 11 further including valve means for selectively controlling the flow of oxidizing fluid and water to said oxidizing fluid and water nozzles respectively of said upper intermediate stage.

13. A system for recovering hydrocarbons of other materials from underground formations penetrated by a borehole, comprising:

a gas generator including, an elongated housing forming a main chamber having an upper end and a lower restricted outlet for the passage of heated gases, a plurality of stages spaced apart along the length of said housing between said upper end and said lower restricted outlet, each stage including a fuel nozzle and an oxidizing fluid nozzle communicating with said chamber, means adapting said gas generator for insertion into a borehole to a level adjacent underground formations penetrated thereby, means for supplying fuel and an oxidizing fluid to each said fuel and oxidizing fluid nozzles respectively of each of said stages for injection into said chamber for ignition; and, valve means for selectively controlling the flow of fuel and oxidizing fluid to each of said fuel and oxidizing fluid nozzles respectively of each of said stages.

14. The system of claim 13 wherein each stage includes a water nozzle communicating with said chamber, and the system further includes, means for supplying water to each of said nozzles of each of said stages for injection into said chamber; and, valve means for selectively controlling the flow of water to each of said water nozzles of each of said stages.

* * * * *